US005124002A

United States Patent [19]

Kade

[11] Patent Number: 5,124,002

[45] Date of Patent: Jun. 23, 1992

[54] HEADBOX WITH TURBULENCE GENERATOR PIPE LAYERS OF DIFFERENT CROSS SECTIONS

[75] Inventor: Werner Kade, Neenah, Wis.

[73] Assignee: J. M. Voith GmbH, Heidenheim, Fed. Rep. of Germany

[21] Appl. No.: 697,715

[22] Filed: May 9, 1991

[30] Foreign Application Priority Data

Jun. 15, 1990 [DE] Fed. Rep. of Germany ..... 4019235

[51] Int. Cl.[5] ..... D21F 1/00

[52] U.S. Cl. ..... 162/343; 162/336

[58] Field of Search ..... 162/336, 343, 216

[56] References Cited

U.S. PATENT DOCUMENTS

| | | | |
|---|---|---|---|
| 3,328,237 | 6/1967 | Notbohm | 162/343 |
| 3,725,197 | 4/1973 | Dahl et al. | 162/343 |
| 3,784,726 | 11/1988 | Evalahti | 162/343 |
| 3,923,593 | 12/1975 | Verseput | 162/343 |
| 4,897,158 | 1/1990 | Weisshuhn et al. | 162/343 |

*Primary Examiner*—Karen M. Hastings

*Attorney, Agent, or Firm*—Baker & Daniels

[57] ABSTRACT

A headbox for a paper machine with a stock channel featuring an outlet gap. The stock channel is preceded by a turbulence generator in the form of a machinewide bundle of many turbulence pipes. The turbulence generator is composed of two or three machinewide layers of turbulence pipes. The turbulence pipes of adjacent layers differ primarily by different flow cross sections, preferably also by different axial spacings a, A.

3 Claims, 2 Drawing Sheets

HEADBOX WITH TURBULENCE GENERATOR PIPE LAYERS OF DIFFERENT CROSS SECTIONS

BACKGROUND OF THE INVENTION

This invention concerns a headbox for a machine for the manufacture of paper, cardboard or similar. Such a headbox is known from the British patent document 1,361,083. Its essential elements are a nozzle type, machinewide stock channel that extends into a machinewide flow-out gap. Preceding the stock channel is a turbulence generator in the form of a machinewide bundle of numerous turbulence pipes. These extend in a preferably straight direction of flow while—viewed in longitudinal section—they converge in flow direction. However, the invention is applicable also with other turbulence pipe setups, for instance where the turbulence pipes are parallel to one another.

As commonly known, the turbulence generator serves to impart to the fibrous stock suspension that flows through the headbox a microturbulent state. This is to prevent the formation of flakes in the fiber suspension which would cause a disuniform fiber distribution in the web being formed (on the following paper machine wire).

To date, care has been taken that the geometric shape of all turbulence pipes of a turbulence generator is as uniform as possible, except for at most the marginal zones. Nevertheless there is often a risk of a streaky fiber deposition on the paper machine wire and, thus, of the creation of longitudinal stripes in the finished paper web. It has heretofore not been possible to eliminate this risk with sufficiently high safety.

Therefore, the problem underlying the invention is to improve the initially described headbox so that the risks of creating longitudinal stripes in the paper web will be avoided with a still higher safety than heretofore, thereby increasing the uniformity of the fiber distribution in the finished web (i.e., improvement of the "formation").

SUMMARY OF THE INVENTION

This problem is solved through the features of the present invention. The core of the invention is constituted by subdividing the turbulence pipe bundle into several superimposed layers, thereby forming (preferably two or three) turbulence pipe layers. These turbulence pipe layers differ among themselves by a varying geometric shape of the turbulence pipes. In this context it is especially important that the clearance of the turbulence pipes in the superimposed turbulence pipe layers is different. The clearance of the turbulence pipes is decisive in creating the degree of turbulence.

The invention ensures that the turbulence generator generates in the fiber suspension flowing through the stock channel superimposed layers in which prevail different turbulence degrees, or stated more accurately, different microturbulence degrees. It goes without saying that the so-called macroturbulences (i.e., wide-space vortexes) are to be avoided because these again would cause a disuniform fiber distribution in the finished web. Within each individual turbulence pipe layer, the turbulence pipes have a uniform geometric shape, as before, so that also the degree of turbulence is uniform across the machine width.

The superimposed layers with the different degrees of microturbulence now have the effect that in the finished paper web there will be superimposed layers created which differ from one another by a different preferred fiber orientation. For instance, the preferred fiber orientation in one of the layers may be mostly parallel to the running direction, while in another layer it is predominantly oblique to the running direction of the web. The result is a paper web with a fiber orientation which, as compared to heretofore, is irregular, so that the so-called transparency of the finished paper appears much more uniform than heretofore. Various designs of the inventional headbox and several embodiments will be described hereafter with the aid of the drawings.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE PREFERRED EMBODIMENT

Figure 1:
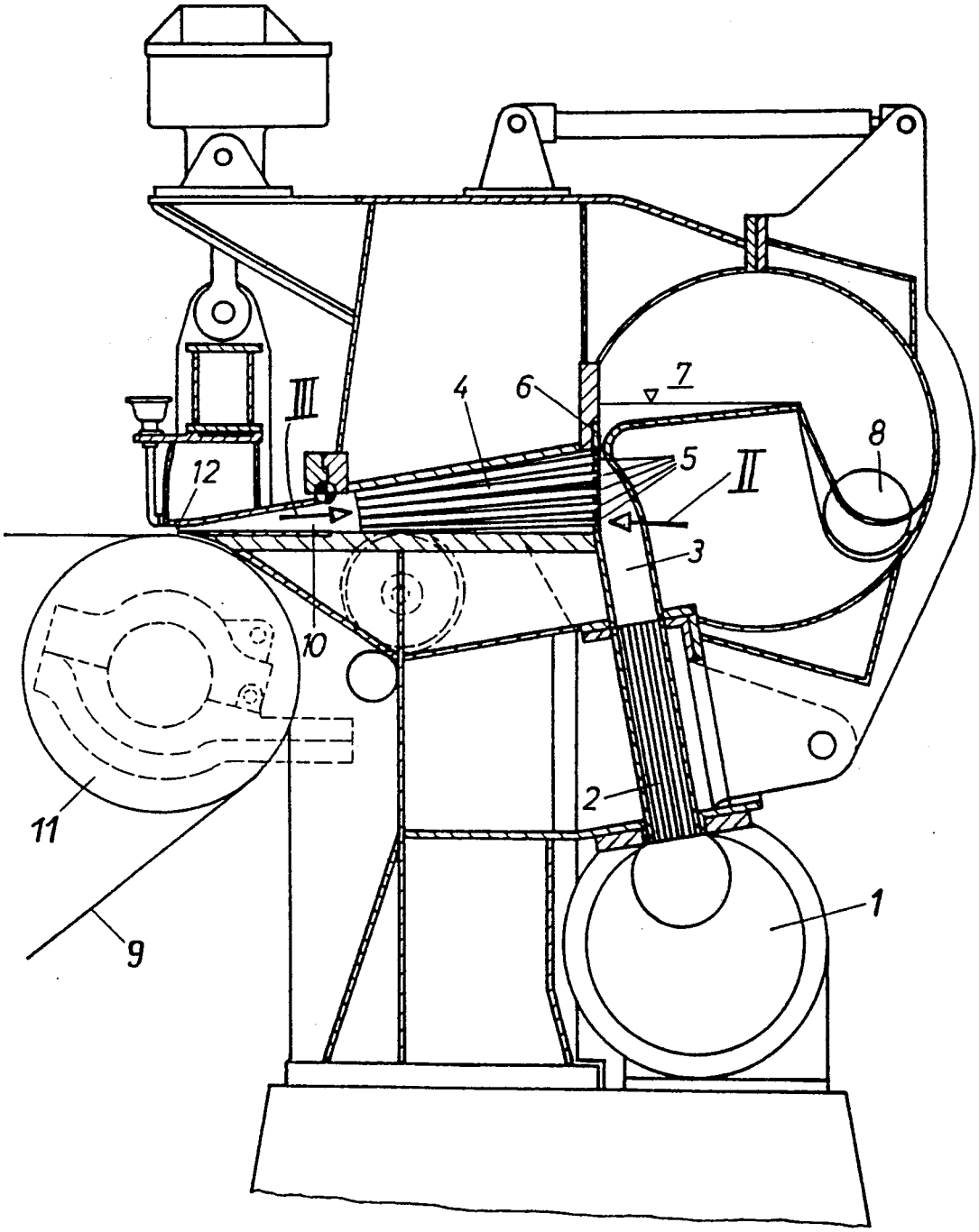
FIG. 1 shows a headbox in longitudinal section.

The headbox illustrated in FIG. 1 and extensively known comprises an inlet pipe 1 that extends transverse to the machine direction and to which a bundle of approximately perpendicularly arranged distribution pipes 2 is connected. The distribution pipes 2 empty in a flow channel 3 which feeds the fiber suspension to the preferably round inlets 5 of the turbulence pipes 4. Above these inlets the flow channel 3 forms a machinewide outlet slot 6 through which excess fiber suspension can flow into a compressed air space 7 with overflow 8. The turbulence pipes 4 empty in a machinewide, nozzle type stock channel 10 that forms a machinewide outlet gap 12. The suspension jet issuing here proceeds in known fashion on a continuous paper machine wire 9 which, among others, runs around a breast roll 11. The remaining parts of the illustrated headbox are well known and, therefore, will not be explained in detail.

The turbulence pipes 4 extend preferably in straight direction while converging toward one another in flow direction. Preferably round according to FIG. 2, their inlets 5 are located at certain distances from one another. From FIG. 3, contrarily, it follows that the outlets of the turbulence pipes 4 are in mutual contact and feature cornered, nesting profiles. According to FIGS. 3 through 5, these are predominantly pentagonal or hexagonal shapes. According to FIGS. 6 and 7, however, these may also be rectangular shapes.

Figure 2:
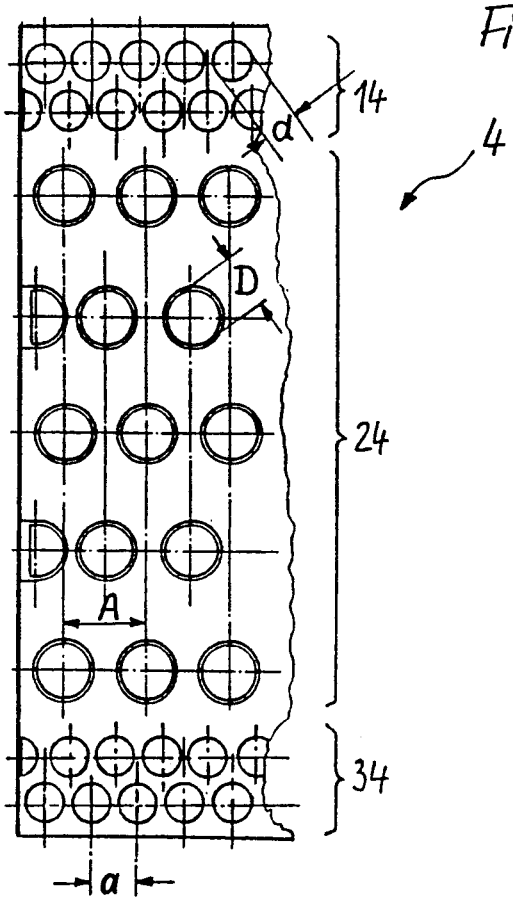
FIG. 2 shows a partial view of the inlets of the turbulence pipes, viewed in the direction of arrow II in FIG. 1.
Figure 3:
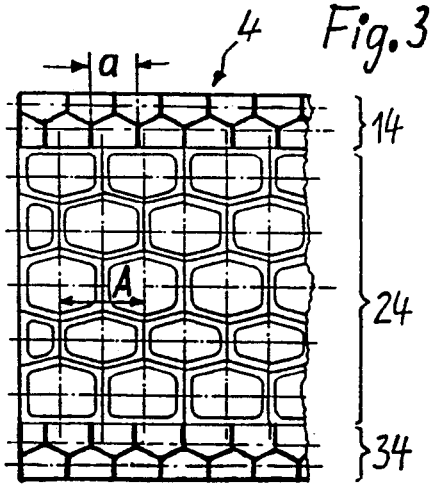
FIG. 3 shows a partial view of the outlets of the turbulence pipes, viewed in the direction of arrow III of FIG. 1.

According to FIGS. 2 and 3, the turbulence generator 4 is composed of turbulence pipe layers 14, 24 and 34. The topmost and the bottommost turbulence pipe layer each comprise two rows of turbulence pipes, the clearance (inside diameter) d is relatively small; just the same, their axial spacing a is relatively small. In comparison, the clearance (inside diameter) D and axial spacing A of the turbulence pipes of the middle turbulence pipe layer 24 (consisting of five rows) are greater.

Figure 4:
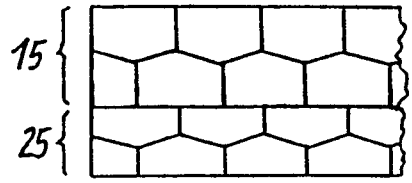
FIGS. 4–7 depict several possible modifications of FIG. 3.

In the variant according to FIG. 4 there are only four rows of turbulence pipes used in total comprising an upper turbulence pipe layer 15 and a bottom turbulence pipe layer 25. As can be seen, the clearance (i.e., the flow cross section) of the turbulence pipes of the upper layer 15 is greater than that of the turbulence pipes of the lower layer 25. The axial spacings between adjacent turbulence pipes, however, are the same in both layers.

Figure 5:
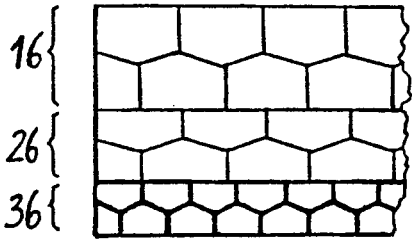

The turbulence generator illustrated in FIG. 5 has three layers 16, 26 and 36 with two rows of turbulence pipes each. As is evident, the flow cross section of the individual turbulence pipes, beginning with the uppermost turbulence pipe layer 16, diminishes from layer to layer. The axial spacings between adjacent turbulence pipes are equal in the two uppermost turbulence pipe layers 16 and 26, whereas in the bottommost turbulence pipe layer 36 they are somewhat smaller than in the two upper layers.

Figure 6:
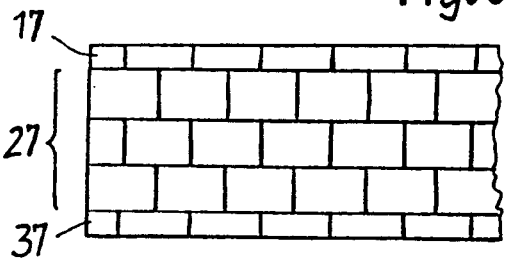

A relatively simple embodiment of the invention is illustrated in FIG. 6. The outlet cross sections all have a rectangular shape here. A middle turbulence pipe layer 27 comprises three superimposed rows of turbulence pipes with a relatively large flow cross section. Additionally there exists an upper, one-row turbulence pipe layer 17 and an as well one-row lower turbulence pipe layer 37. The turbulence pipes of the two latter layers 17 and 37 have relatively small flow cross sections. The axial spacings between adjacent turbulence pipes are equal in all layers.

Figure 7:
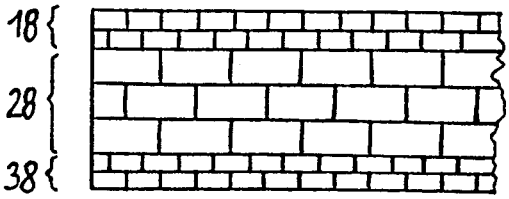

The embodiment illustrated in FIG. 7 corresponds essentially with that according to FIGS. 2 and 3. Differences exist only insofar as the outlets of the turbulence pipes in FIG. 7 are rectangular (as in FIG. 6) and that the middle turbulence pipe layer (as well as in FIG. 6) comprises only three rows of turbulence pipes.

According to FIG. 1, the direction of flow through the turbulence generator 4 and through the stock channel 10 is essentially horizontal. The invention is applicable also to headboxes that may have any other flow-out direction, for instance oblique or essentially vertically upward.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A headbox for a machine for the manufacture of paper or cardboard from a flowing fibrous suspension, said headbox and said machine each having a width, said headbox comprising:

a turbulence generator, said turbulence generator comprising a plurality of turbulence pipes extending in the direction of flow of said fibrous suspension, said turbulence pipes being arranged in at least two layers and situated so that each of said layers extends substantially the width of said headbox and said machine, each of said turbulence pipes having a flow cross section, wherein the flow cross section of each pipe throughout the entire pipe length in one of said layers is smaller than the flow cross section of each pipe throughout the entire pipe length in an adjacent layer, the turbulence pipes in said one layer being arranged in at least two adjacent rows, each row extending substantially the width of said headbox; and a stock channel for receiving said suspension from said turbulence generator, said stock channel extending substantially the width of said machine, said stock channel further including a flow out gap for said suspension.

2. A headbox according to claim 1, in which said turbulence pipes have respective axes, wherein the spacing between the axes of two adjacent turbulence pipes in one of said layers is smaller than the spacing between the axes of two adjacent turbulence pipes in an adjacent layer.

3. A headbox according to claim 1, in which said turbulence pipes have respective axes, wherein the spacing between the axes of two adjacent turbulence pipes in one of said layers is equal to the spacing between the axes of two adjacent turbulence pipes in an adjacent layer.

* * * * *